US008579344B2

(12) United States Patent
Yuen

(10) Patent No.: US 8,579,344 B2
(45) Date of Patent: Nov. 12, 2013

(54) CARRIER FOR A BOX

(75) Inventor: Wai-Lun Yuen, Brooklyn, NY (US)

(73) Assignee: Glopack, Inc., Brooklyn, NY (US)

( * ) Notice: Subject to any disclaimer, the term of this patent is extended or adjusted under 35 U.S.C. 154(b) by 132 days.

(21) Appl. No.: 12/654,275

(22) Filed: Dec. 16, 2009

(65) Prior Publication Data

US 2011/0011905 A1 Jan. 20, 2011

Related U.S. Application Data

(60) Provisional application No. 61/213,802, filed on Jul. 16, 2009.

(51) Int. Cl.
*A45F 5/00* (2006.01)

(52) U.S. Cl.
USPC ..... 294/149; 294/150

(58) Field of Classification Search
USPC ..... 294/149, 150; 383/37, 6, 7, 10
See application file for complete search history.

(56) References Cited

U.S. PATENT DOCUMENTS

| | | | | |
|---|---|---|---|---|
| 2,687,321 | A | 8/1954 | Toffolon | |
| 3,214,072 | A * | 10/1965 | Brown | 294/152 |
| 3,701,559 | A | 10/1972 | Marino et al. | |
| 4,140,257 | A | 2/1979 | Peterson | |
| 4,209,116 | A | 6/1980 | Hendricks | |
| 5,213,145 | A * | 5/1993 | Huang et al. | 141/391 |
| 5,282,686 | A * | 2/1994 | Haber | 383/10 |
| 5,524,949 | A | 6/1996 | Mooney | |
| 5,863,088 | A | 1/1999 | Kelly, Sr. et al. | |
| 5,865,313 | A * | 2/1999 | Huang et al. | 206/554 |
| 6,033,000 | A * | 3/2000 | Sandeen | 294/149 |
| 6,109,678 | A | 8/2000 | Esfandiari et al. | |
| 6,435,350 | B1 * | 8/2002 | Huang et al. | 206/554 |
| 6,824,346 | B2 | 11/2004 | Coblentz | |
| 7,055,876 | B2 | 6/2006 | Woldekidan | |
| 7,270,358 | B2 | 9/2007 | Hirsch | |
| 2007/0108247 | A1 * | 5/2007 | Bardes | 224/581 |
| 2008/0101729 | A1 * | 5/2008 | Dickinson | 383/6 |

FOREIGN PATENT DOCUMENTS

| | | |
|---|---|---|
| GB | 960634 | 6/1964 |

* cited by examiner

*Primary Examiner* — Saul Rodriguez
*Assistant Examiner* — Gabriela Puig
(74) *Attorney, Agent, or Firm* — Ladas & Parry, LLP

(57) ABSTRACT

A carrier comprising an elongated flexible portion comprising a base having a first side and a second side, a first pair of arms extending from the first side of the base, a second pair of arms extending from the second side of the base, the first pair of arms being joined to a first end portion having a central area, the second pair of arms being joined to a second end portion having a central area, a first strip portion having a first end and a second end; the first end of the first strip portion being detachably connected to the first side of the base, and the second end of the first strip portion being connected to the first end portion, a second strip portion having a first end and a second end; the first end of the second strip portion being detachably connected to the second side of the base, and the second end of the second strip portion being connected to the second end portion.

10 Claims, 3 Drawing Sheets

CARRIER FOR A BOX

This application claims the benefit of U.S. Provisional Application No. 61/213,802, filed Jul. 16, 2009.

TECHNICAL FIELD

The invention is directed to a carrier for a box, and the like, which allows the box, or a plurality of boxes, to be secured within the carrier and transported in a horizontal position within the carrier. The invention is also directed to a method for securing and carrying a box, or the like, using the carrier.

BACKGROUND OF THE INVENTION

Typically, square or rectangular boxes are used for carrying food items, such as pizza, for which it is necessary to secure and carry the box in a substantially horizontal position while transporting the box containing the food item. Conventional grocery carriers are not useful for this purpose, since the bags are of insufficient size, and the opening of the bag too narrow, to accommodate a pizza box.

Prior art carriers for boxes have thus been adapted by providing cut-out portions in the carrier to accommodate the four corners of the box, typically for boxes which are required to be carried in one particular orientation to prevent the contents of the box from spilling out, or to prevent the contents from moving around inside the box.

One of the shortcomings of the prior art carriers, however, is that the boxes are usually insufficiently secured within the carrier, so that the boxes can easily fall out of the container, especially if one of the carrying handles is accidentally released by the user.

It is therefore a primary object of the present invention to provide a box carrier which would keep the box or boxes held in the carrier in a secure position.

It is a further objection of the present invention to provide a box carrier which would prevent the box or boxes from falling out of the carrier if one of the handles of the carrier is accidentally let go by the user.

SUMMARY OF THE INVENTION

These problems and others are addressed by the present invention which comprises a flexible carrier comprising a pair of detachable strips which, when detached at one of their ends from the carrier body, form a means of securing a container within the carrier when the detached ends of the strips are secured together, for example, by means of a knot. Once the item(s) are secured within the carrier, it will be appreciated that the item will not fall from the carrier even if one of the handles of the carrier slips from the user's grasp.

BRIEF DESCRIPTION OF THE DRAWINGS

These and other objects of the present invention will be appreciated and understood by those skilled in the art from the detailed description of the preferred embodiments of the invention and the following drawings of which.

DETAILED DESCRIPTION OF THE INVENTION

Figure 1:
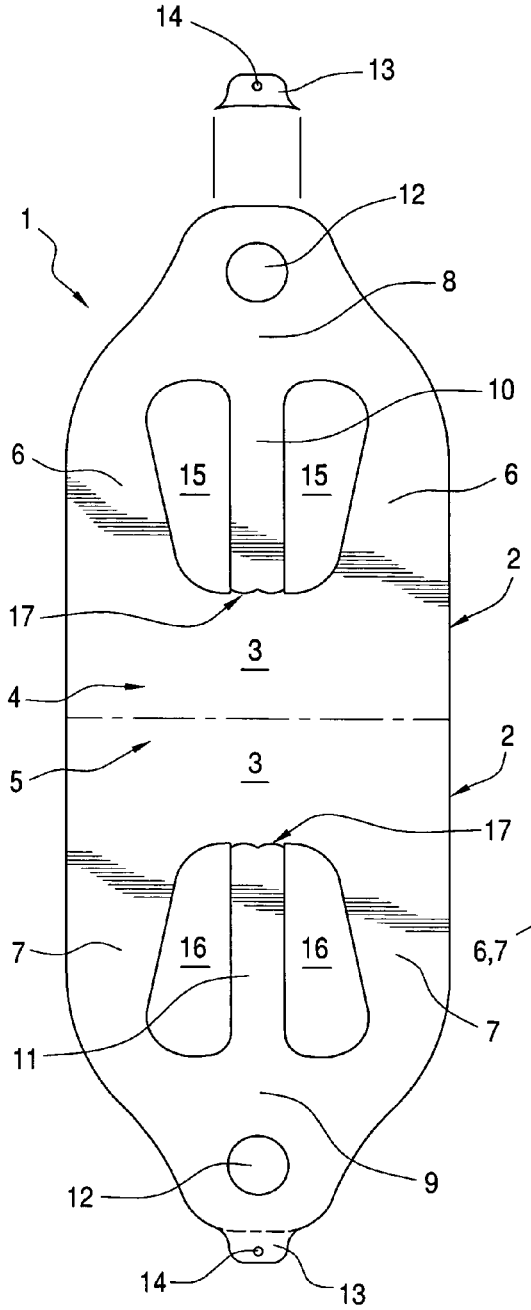
FIG. 1 is a line drawing of the carrier according to the present invention in an open, unfolded configuration.
Figure 2:
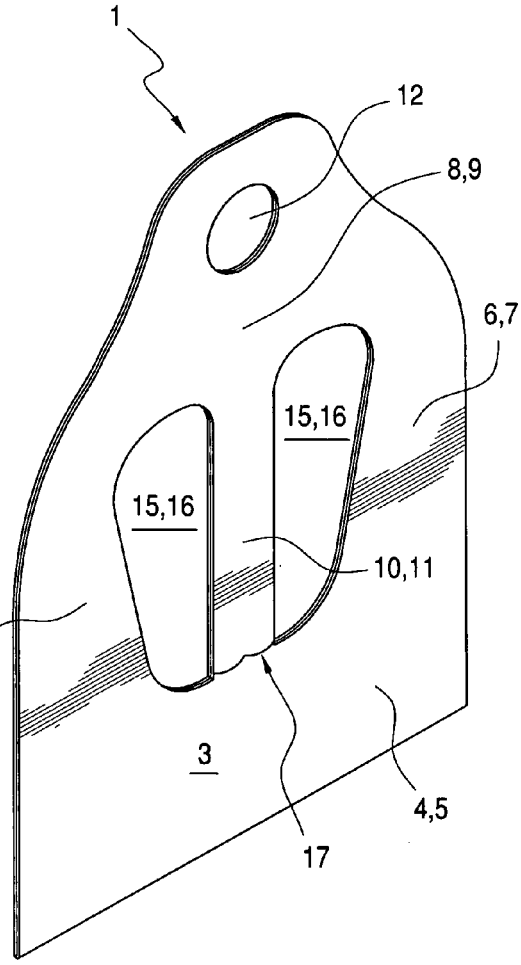
FIG. 2 is a line drawing showing the carrier according to the present invention in a folded, two-layer configuration.

With reference to the FIGS. 1 and 2, it can be seen that the carrier 1 comprises an elongated flexible portion 2 comprising a base 3 having a first side 4 and a second side 5; a first pair of arms 6 extending from the first side 4 of said base 3; a second pair of arms 7 extending from said second side 5 of said base 3; said first pair of arms 6 being joined to a first end portion 8; said second pair of arms 7 being joined to a second end portion 9; a first strip portion 10 having a first end and a second end; said first end of said first strip portion 10 being detachably connected at detachable connection 17 to said first side 4 of said base 3, and said second end of said first strip portion 10 being connected to said first end portion 8; a second strip portion 11 having a first end and a second end; said first end of said second strip portion 11 being detachably connected at detachable connection 17 to said second side 5 of said base, and said second end of said second strip portion 11 being connected to said second end portion 9.

A cut-out 12 is present in said first 8 and second 9 end portions, the end portions 8, 9 with cut-outs serving as carrying handles. When the two halves of the carrier are brought together, the user places his or her fingers through the two cut-outs to grip the carrier in a closed configuration.

A tab 13 having an aperture 14 therein may be detachably connected to said first 8 and second end 9 portions. The tab 13 and aperture 14 combination may be used to hang the carrier from a hook or similar device, and the carrier 1 detached from the tab 13 for use.

On one half of the carrier, the base 3, pair of arms 6, end portion 8, and strip 10 define a pair of cut-outs 15 when the first end of strip portion 10 is detachably connected at detachable connection 17 to the first side 4 of base 3. On the other half of the carrier, the base 3, pair of arms 7, end portion 9, and strip 11 define a pair of cut-outs 16 when the first end of the strip 11 is detachably connected at detachable connection 17 to the second side 5 of base 3.

Figure 3:
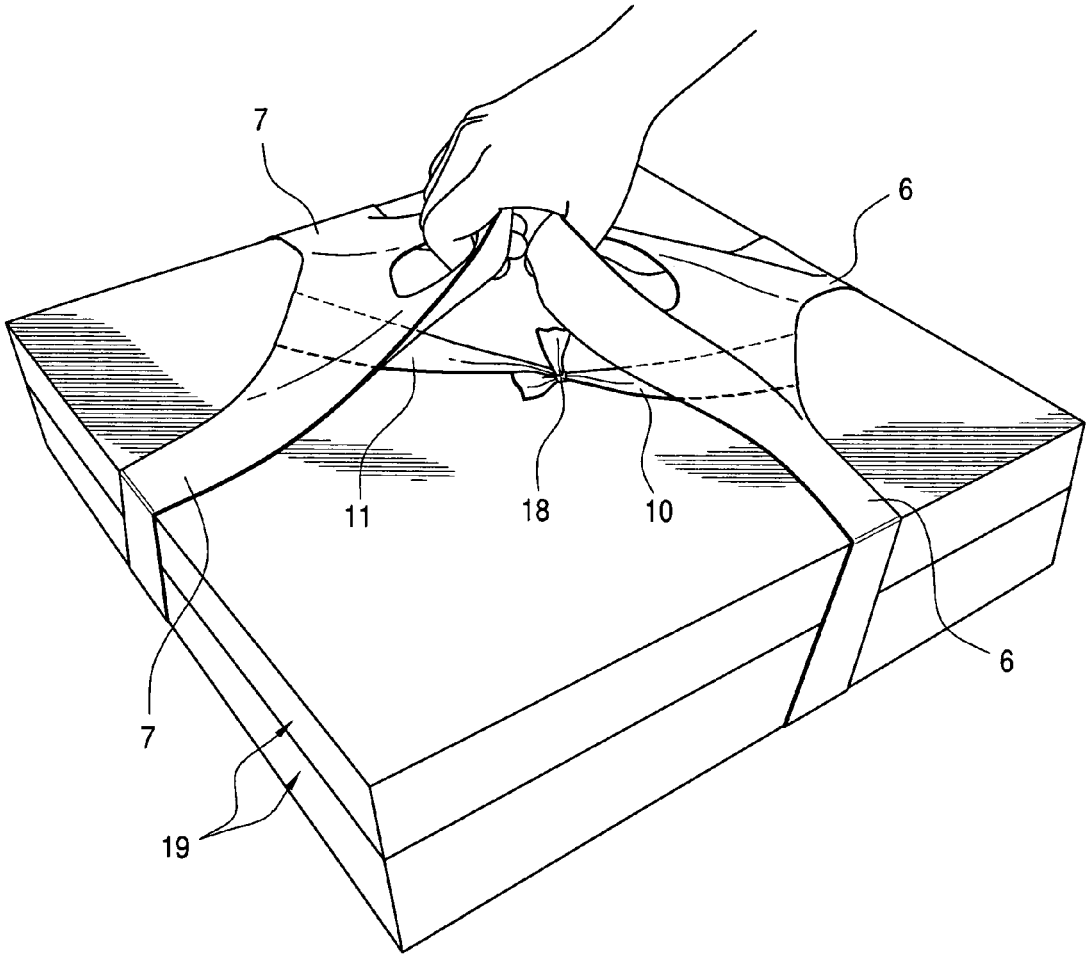
FIG. 3 is a line drawing showing a user gripping the carrier in connection with transporting items secured within the carrier by the tied strip portions.
Figure 4:
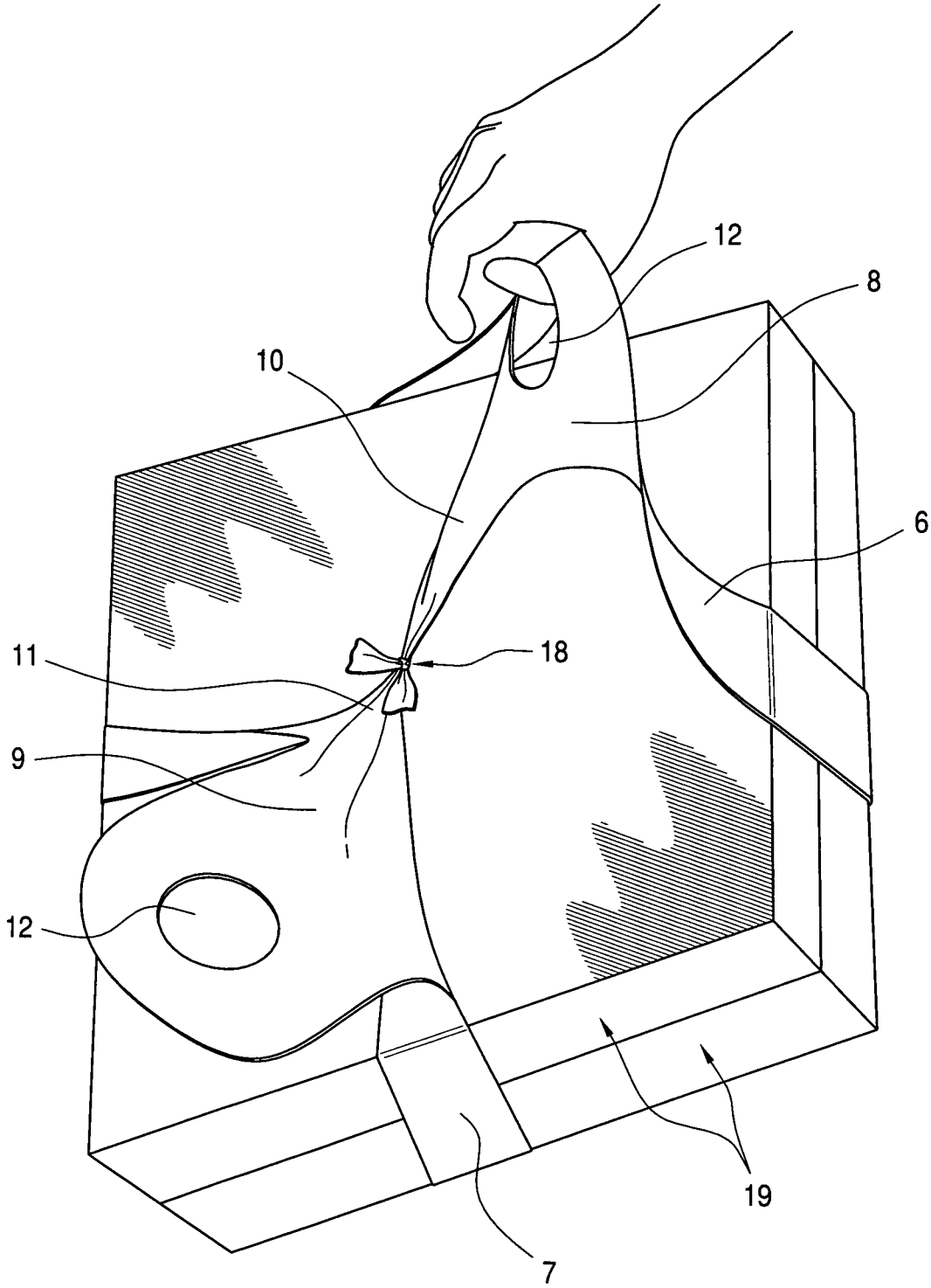
FIG. 4 is a line drawing showing a user accidentally letting go of one handle of the carrier and the pizza box remaining secured in the carrier by the tied strip portions.

To secure a box 19 within the carrier 1, the box 19 is first placed on the carrier 1 with the carrier 1 in the unfolded configuration, with opposing corners of the box 19 pointing towards opposing end portions 8, 9. Then the second end of strip portions 10, 11 are detached from base 3 and secured together by any suitable means, preferably by tying the detached second ends of the strip portions 10, 11 together in a knot 18. The carrier 1 with box(es) 19 secured therein can then be picked up by the user by means of the cut-outs 12 and the carrier transported (FIG. 3). If the user accidentally lets one handle of the carrier slip from their grasp, the box 19 will remain secured in the carrier 1 by the knot 18 securing the strip portions 10, 11 (FIG. 4).

For transporting a single or a plurality of boxes of various sizes and various shapes in a horizontal position. More particularly, the device may be used to transport boxes containing baked goods, including pizza, floral arrangements, cartons of beverages, and the like.

The carrier may be used for transporting a single or a plurality of boxes of various sizes and various shapes in a horizontal position. More particularly, the carrier may be used to transport boxes containing baked goods, including pizza, floral arrangements, cartons of beverages, and the like.

The carriers may be made of any flexible, deformable, material, including fabrics, including cotton, Nylon, and other polymers. Preferably, the carriers are manufactured from standard materials used to make traditional carrier bags for transporting grocery items, including plastic of the Low Density Polyethylene (LDPE) or High Density Polyethylene (HDPE) type. The carriers may also be manufactured from biodegradable polythene.

The carrier may be of different colors and textures, and have printed material thereon.

The carrier may be cut from a single layer sheet of material and then folded about its midpoint to form the carrier. In this way, the strips are integrally formed with the rest of the carrier. In a preferred embodiment, the carrier is cut from a double layer sheet so that the carrier is ready for use after being cut without the need for folding.

The carrier may be dimensioned to accommodate boxes or articles of different sizes.

While preferred embodiments of the invention have been shown and described, various modifications and substitutions may be made thereto without departing from the spirit and scope of the invention. Accordingly, it is to be understood that the present invention has been described by way of illustration only, and this description should not be construed as limiting to the several claims appended hereto.

The invention claimed is:

1. A carrier comprising: an elongated flexible portion comprising a base having a first side and a second side; a first pair of arms extending from the first side of said base; a second pair of arms extending from said second side of said base; said first pair of arms being joined to a first end portion having a central area; said second pair of arms being joined to a second end portion having a central area; a first strip portion having a first end and a second end; said first end of said first strip portion being detachably connected to said first side of said base, and said second end of said first strip portion being permanently connected to said first end portion; a second strip portion having a first end and a second end; said first end of said second strip portion being detachably connected to said second side of said base, and said second end of said second strip portion being permanently connected to said second end portion wherein said first ends of the first and second strip portions when detached form free ends of said strip portions;

wherein said first side of said base, said first pair of arms, said first end portion, and said first strip portion define a first pair of apertures on said first side of said carrier; and wherein said second side of said base, said second pair of arms, said second end portion, and said second strip portion define a second pair of apertures on said second side of said carrier;

wherein the first and second pair of apertures are dimensioned to receive corner portions of a box; and wherein said first end of said first strip portion and said first end of said second strip portion are adapted to be secured together to retain a box within the carrier.

2. The carrier according to claim 1, wherein a cut-out is present in said first and second end portions.

3. The carrier according to claim 1, wherein the first and second strip portions are integral with the carrier.

4. The carrier according to claim 3, wherein the polymer is low density polyethylene.

5. The carrier according to claim 3, wherein the polymer is high density polyethylene.

6. The carrier according to claim 1 manufactured from a polymer.

7. The carrier according to claim 1 wherein the carrier is manufactured from a single sheet of material.

8. The carrier according to claim 1, wherein a tab having an aperture therein is detachably connected to said first and second end portions.

9. A method of securing a box within a carrier as set forth in claim 1, comprising, providing a means for supporting the box; providing a means for securing the box to the support means, said securing means comprising a plurality of strips having a first end and a second end detaching said first end of each of said strips from the support means; securing said two first ends of said strips together to secure the box within the carrier.

10. The carrier according to claim 1, wherein said first and second pair of apertures are asymmetrical.

* * * * *